US007007602B2

(12) United States Patent
Kiyota

(10) Patent No.: US 7,007,602 B2
(45) Date of Patent: Mar. 7, 2006

(54) METHOD AND APPARATUS FOR CONTROLLING A CUTTING POSITION OF A WEB MEMBER AND DEVICE THEREFOR

(75) Inventor: Hirotaka Kiyota, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/853,275

(22) Filed: May 26, 2004

(65) Prior Publication Data

US 2004/0261638 A1 Dec. 30, 2004

Related U.S. Application Data

(62) Division of application No. 10/382,536, filed on Mar. 7, 2003.

(30) Foreign Application Priority Data

Mar. 8, 2002 (JP) ..... 2002-63073

(51) Int. Cl.
*B41F 13/56* (2006.01)
*B41F 13/54* (2006.01)

(52) U.S. Cl. ..... 101/226; 101/227; 101/228

(58) Field of Classification Search ..... 101/227, 101/228, 485, 226, 224, 248, 177; 83/113, 83/74, 486, 219; 226/45, 2, 31, 111
See application file for complete search history.

(56) References Cited

U.S. PATENT DOCUMENTS 3,591,279 A * 7/1971 Gardner et al. ..... 355/29
4,011,975 A * 3/1977 Brown, Jr. ..... 226/2
4,722,275 A * 2/1988 Taguchi et al. ..... 101/228
4,750,659 A * 6/1988 Maier et al. ..... 226/92
4,896,605 A 1/1990 Schroder ..... 101/486
4,955,265 A 9/1990 Nakagawa et al. ..... 83/74
5,016,182 A * 5/1991 Bergland et al. ..... 700/125
5,052,296 A * 10/1991 Shiba ..... 101/227
5,398,702 A * 3/1995 Belvederi ..... 131/84.1
5,438,926 A * 8/1995 Hudyma et al. ..... 101/227
5,659,538 A * 8/1997 Stuebe et al. ..... 700/124
5,740,054 A 4/1998 Durr et al. ..... 700/122
5,807,227 A 9/1998 Field ..... 493/424
5,894,797 A 4/1999 Brennan et al. ..... 101/226
5,927,196 A 7/1999 Murray ..... 101/219
5,996,491 A * 12/1999 Kishine et al. ..... 101/223
6,085,956 A 7/2000 Sainio et al. ..... 226/4
6,092,466 A * 7/2000 Koch et al. ..... 101/485
6,167,806 B1 1/2001 Chretinat et al. ..... 101/220
6,273,313 B1 8/2001 Noll et al. ..... 226/30
6,354,214 B1 3/2002 Tokiwa ..... 101/484
6,401,583 B1 6/2002 Kishine et al. ..... 83/295
6,499,403 B1 12/2002 Laulanet ..... 101/486

(Continued)

FOREIGN PATENT DOCUMENTS

JP 360228153 A * 4/1984

(Continued)

*Primary Examiner*—Daniel J. Colilla
*Assistant Examiner*—Wasseem H. Hamdan
(74) *Attorney, Agent, or Firm*—Birch, Stewart, Kolasch & Birch, LLP

(57) ABSTRACT

A method and apparatus for controlling the cutting position of a web member in a printing press by setting a reference tensile value, detecting the present tensile value of a web in a printing press during an actual printing operation, and controlling the starting and stopping of the position of the web member as a function of the difference between the reference tensile value and the present tensile value.

6 Claims, 9 Drawing Sheets

U.S. PATENT DOCUMENTS

| | | | | |
|---|---|---|---|---|
| 6,526,889 | B1 | 3/2003 | Tokiwa | 101/485 |
| 6,543,353 | B1 | 4/2003 | Ohlhauser et al. | 101/224 |
| 6,554,266 | B1 | 4/2003 | Nanba et al. | 270/47 |
| 6,595,131 | B1 | 7/2003 | Armstrong | 101/226 |
| 6,601,506 | B1 * | 8/2003 | Dauer | 101/248 |
| 6,766,737 | B1 * | 7/2004 | Glockner et al. | 101/228 |

FOREIGN PATENT DOCUMENTS

| | | | |
|---|---|---|---|
| JP | 1978-38309 | * | 9/1986 |
| JP | 401242352 | * | 3/1989 |
| JP | 03256962 A | * | 11/1991 |
| JP | 406048628 A | * | 2/1994 |

* cited by examiner

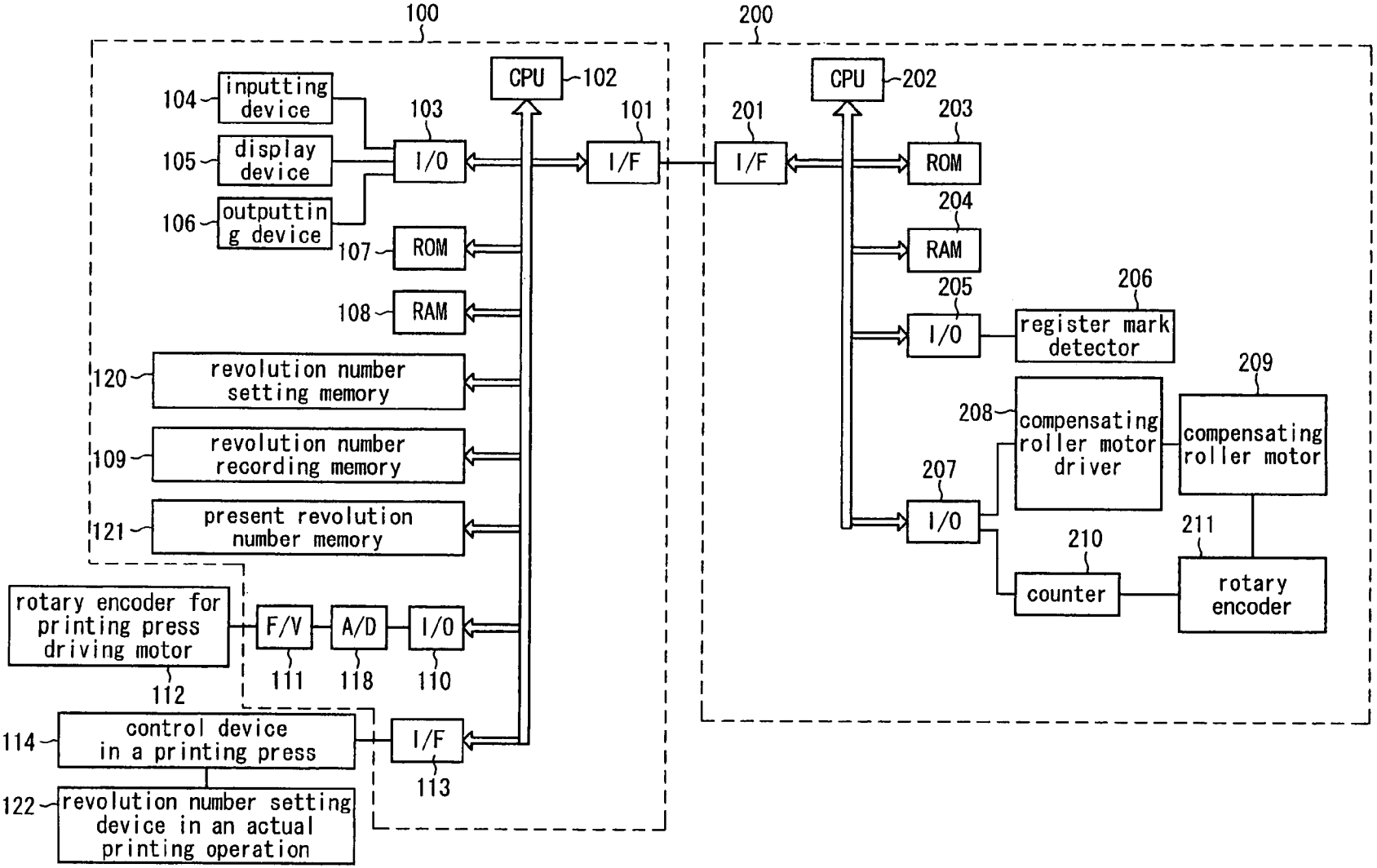
FIG. 1
100
200
CPU
102
I/F
101
I/O
103
inputting device
104
display device
105
outputting device
106
ROM
107
RAM
108
revolution number setting memory
120
revolution number recording memory
109
present revolution number memory
121
I/O
110
A/D
118
F/V
111
rotary encoder for printing press driving motor
112
I/F
113
control device in a printing press
114
revolution number setting device in an actual printing operation
122
CPU
202
I/F
201
ROM
203
RAM
204
I/O
205
register mark detector
206
I/O
207
compensating roller motor driver
208
compensating roller motor
209
counter
210
rotary encoder
211

METHOD AND APPARATUS FOR CONTROLLING A CUTTING POSITION OF A WEB MEMBER AND DEVICE THEREFOR

This application is a Division of non-provisional application Ser. No. 10/382,536, filed on Mar. 7, 2003.

The entire disclosure of Japanese Patent Application No. 2002-063073 filed on Mar. 8, 2002 including specification, claims, drawings and summary is incorporated herein by reference in its entirety.

BACKGROUND OF THE INVENTION

1. Field of the Invention

The present invention relates to a method and apparatus for controlling a cutting position of a web member in a web cutting unit and a device therefor.

2. Prior Art

A conventional web rotary printing press is shown in FIGS. 8A, 8B and 8C.

In the drawings, a web member 1 is firstly folded along a centerline in a longitudinal direction and then cut. Each cut web piece is folded along a centerline in a transverse direction.

As shown in FIG. 8A through FIG. 8C, a web member 1 is printed by a printing unit in a rotary printing press, dried, and then cut and folded by a folding unit.

The web member 1 is fed from a compensation roller 3 to a drag roller 4 by a guide roller 2. The web member 1 is folded along a centerline in a longitudinal direction by a triangle former 5 located in a downstream side. The folded web member 1 is fed to a cutting cylinder 8 through a lead roller 6 and a nipping roller 7.

The web member 1 is cut and folded in a centerline along a transverse direction after passing the cutting cylinder 8 and the folding cylinder 9 before passing a gripping cylinder 10. Then, each piece of cut web member 1 is discharged from a conveyor 11.

On the web member 1, the same printing image such as a picture pattern 12 is continuously printed. The web member 1 should be correctly cut along a boarder line between the both adjacent picture patterns 2.

However, due to some unstable factors, for example, physically unevenness of the web member 1 and a rotational unbalance and variable load of mechanical parts, control accuracy of a cutting position is reduced.

In order to improve the control accuracy of the cutting position, various devices for controlling a cutting position, so called as cut-off-control devices, have been developed.

As one of the devices for controlling a cutting position, it has been known a device for controlling a cutting position by adjusting a compensating roller 3 forwardly/rewardly in accordance with a difference between a pulse signal generated with respect to each cutting length by a cutting reference signal generator 13 mounted on the cutting cylinder 8 and a signal generated by a detecting head 14 positioned at an upper portion of the drag roller 4 for detecting each picture pattern 12.

In an above described control device for controlling an apparatus for controlling a cutting position in a web rotary printing press, the control device is switched on/off simultaneously with a cylinder in the printing press is attached/detached. In such a moment, tensile force of the web member 1 is varying so that a position of the compensating roller 3 is displaced from an original printing position. Therefore, in order to print picture patterns on a web again, cutting is not operated at a correct position until the compensating roller 3 is returned to the original printing position. It has to wait for a time and waste a large amount of printing materials.

For example, as shown in FIGS. 7A, 7B and 7C, the smaller the rotational speed of the printing press (revolution number per unit time) becomes, the smaller a tensile value of the web member 1 becomes. The larger the rotational speed of the printing press becomes, the larger the tensile value of the web member 1 becomes. When the rotational speed of the printing press becomes constant, the tensile value becomes stable. However, the cylinder of the printing press is pulled out and pushed back in the case when the rotational speed of the printing press is at the predetermined speed. If the apparatus for controlling a cutting position is switched on during an interval between the cylinder being rotated at a constant speed and the cylinder of the printing press being pulled out, and during an interval between the cylinder of the printing press being pushed back and the cylinder being rotated at a constant speed, a position of the compensating roller 3 is largely displaced due to varying tensile value of the web member 1. In the case where the printing press is intermitted and restarted, the position of the compensating roller 3 can not be quickly returned to a position where the cylinder of the printing press can be rotated at the constant speed. Thus, a large amount of printing material such as pieces of web incorrectly cut is wasted.

Therefore, the position of the compensating roller 3 is manually adjusted in an interval as shown in a bi-directional arrow in FIG. 7A so as to cut the web member 1 quickly on a correct boarder line.

A purpose of the present invention is to resolve the above drawbacks and to provide a control device for controlling an apparatus for controlling a cutting position of a web cutting unit in a printing press wherein the control device is switched ON/OFF in accordance with the rotational speed of the printing press or the tensile force of the web in an actual printing operation.

SUMMARY OF THE INVENTION

To resolve the above subject, a method and apparatus for controlling a cutting position of a web member of a web cutting unit according to the present invention detects unstable factors such as a revolution of a cylinder and a tensile value of a web member in a printing press.

In the case where the unstable factor is a revolution number of a printing cylinder, a method according to the present invention comprises a revolution number detecting step for detecting revolution number of a printing press, a revolution number setting step for setting a revolution number in an actual printing operation, and a control step for controlling the apparatus for controlling a cutting position of a web member in accordance with signals output in the revolution number detecting step and the revolution number setting step.

The method further comprises a step for starting a control of the apparatus for controlling a cutting position of a web member in the case where a present revolution number detected in the revolution number detecting step is larger than a number which is the set revolution number read out from the revolution number setting step multiplied by a predetermined ratio (for example 95%), and a step for stopping a control of the apparatus for controlling a cutting position of a web member in the case where a present revolution number detected in the revolution number detecting step is less than a number which is the set revolution number read out from the revolution number setting step multiplied by a predetermined ratio.

In the case where the unstable factor is a tensile value of a web member, a method according to the present invention comprises a tensile force detecting step for detecting a tensile value of a web member, and a control step for controlling apparatus for controlling a cutting position of a web member in accordance with a signal output in the tensile force detecting step.

The method further comprises a step for starting a control of the apparatus for controlling a cutting position of a web member in the case where a difference between a present tensile value of a web member detected in the tensile detecting step and the reference tensile value is less an allowable range and a step for stopping a control of the apparatus for controlling a cutting position of a web member in the case where a difference between a present tensile value of a web member detected in the tensile detecting step and the reference tensile value is larger an allowable value.

To resolve the above subject, a device for controlling apparatus for controlling a cutting position of a web member of a web cutting unit in a printing press comprises an unstable factor detecting means, a stable factor setting means, and control means for controlling a cutting position in a web member in accordance with signals from the unstable factor detecting means and the stable factor setting means.

In the case where the unstable factor is a revolution number, the device according to the present invention comprises revolution number detecting means for detecting a revolution number of a printing press, revolution number setting means for setting a revolution number of the printing press in an actual printing operation, and apparatus for controlling a cutting position in a web member in accordance with signals output from the revolution number detecting means and the revolution number setting means.

In the case where the unstable factor is a tensile value of a web member, the device according to the present invention comprises tensile detecting means for detecting a tensile value of a web member and apparatus for controlling a cutting position of a cutting unit in accordance with a signal from the tensile detecting means.

The apparatus further comprises a compensating roller movably supported so as to vary a transport length of a web member and adjust a cutting position of the web member, detecting means for detecting a mark printed on the web member, and control means for moving a position of the compensating roller in accordance with a signal output from the detecting means.

BRIEF DESCRIPTION OF THE DRAWINGS

The present invention will become more fully understand from the detailed description given herein below and accompanying drawings which are given by way of illustrating only, and thus are not limitation of the present invention, and wherein;

FIG. 1 is a block diagram for showing a first embodiment according to a control device for controlling an apparatus for controlling a cutting position of a web member of a cutting unit in a printing press;

DETAILED DESCRIPTION OF THE PREFERRED EMBODIMENTS

Figure 2:
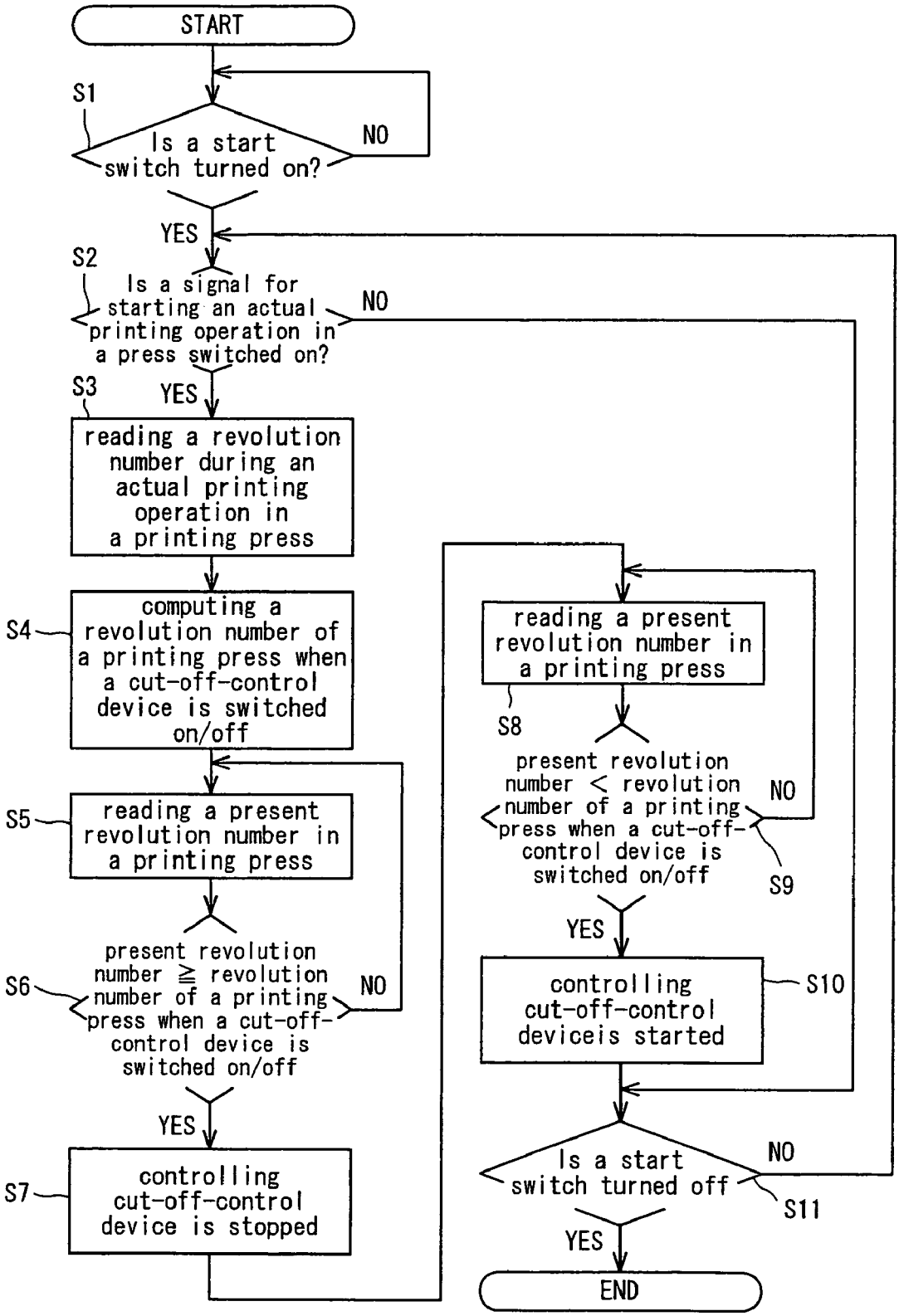
FIG. 2 is a flow chart for showing an operation of a control device for an apparatus for controlling a cutting position of a web member of a cutting unit.

In the present invention, a control device, equipped at an apparatus for controlling a cutting position of a cutting unit in a printing press, is switched ON/OFF in accordance with a condition whether a revolution number of a printing press is different from a revolution number of the printing press in an actual printing operation or tensile force of a printing press such as a tensile force with respect to a web member is stable.

The present invention will be explained with reference to accompanying drawings.

FIG. 1 shows the first embodiment of a control device for controlling a web member cutting position in a web member cutting device according to the present invention.

As shown in FIG. 1, a control device 100 is connected to a cut-off-control device 200 through I/F 101 and 201.

The control device 100 comprises a CPU 102, an I/O 103, an input device 104, a display device 105 and an output device 106, wherein the input device 104, a display device 105 and the output device 106 is connected to the CPU 102 through the I/O 103, respectively.

The control device 100 further comprises ROM 107, RAM 108, memory means 109 for memorizing a revolution number of a printing press in the case of switching on/off the cut-off-control device, a memory 120 for memorizing a set revolution number in an actual printing operation of the printing press (set by a revolution number setting device 122) and memory 121 for memorizing a present revolution number of the printing press.

The memory means 109 for memorizing/outputting a revolution number records a revolution number of a printing press in the case where the cutoff-control switch is switched on/off.

The control device 100 is connected to a rotary encoder 112 for a printing press driving motor through I/O 110 and F/V 111 and connected to a control device 114 of a printing press through I/F 113.

A device for setting a set revolution number in an actual printing operation of the printing press is connected to the control device 114 of the printing press.

On the other hand, the cut-off-control device 200 comprises CPU 202, ROM 203, RAM 204, an I/O 205 and a register mark detector 206 wherein the register mark detector 206 is connected to the CPU 202 through the I/O 205.

The register mark detector 206 determines a cutting position by detecting a register mark wherein the register mark is marked in an outside of the picture pattern.

The cut-off-control device 200 is connected to a compensating roller motor 209 through I/O 207 and a compensating roller motor driver 208 and connected to a rotary encoder 211 through a counter 210.

Figure 8A:
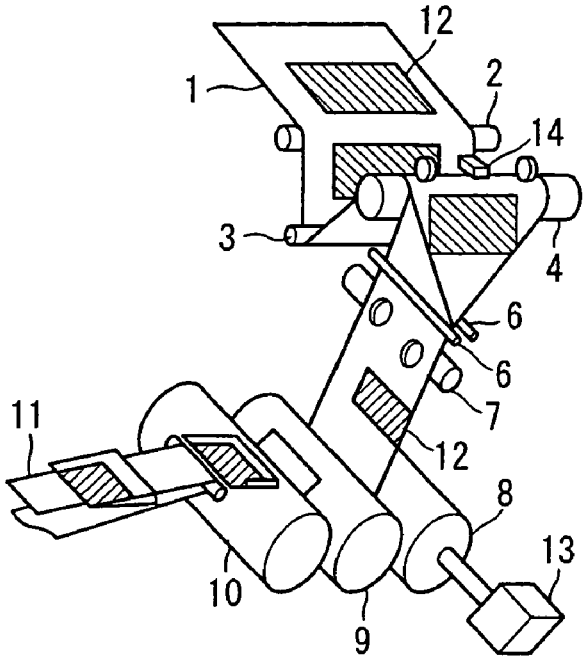
FIG. 8A PRIOR ART
FIG. 8A is a perspective view of a conventional folding apparatus.
Figure 8B:
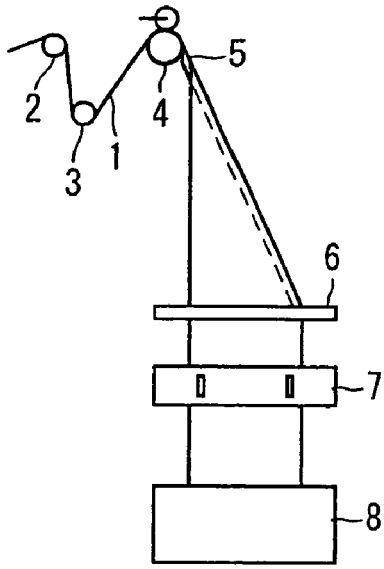
FIG. 8B PRIOR ART
FIG. 8B is a side view of the conventional folding apparatus.
Figure 8C:
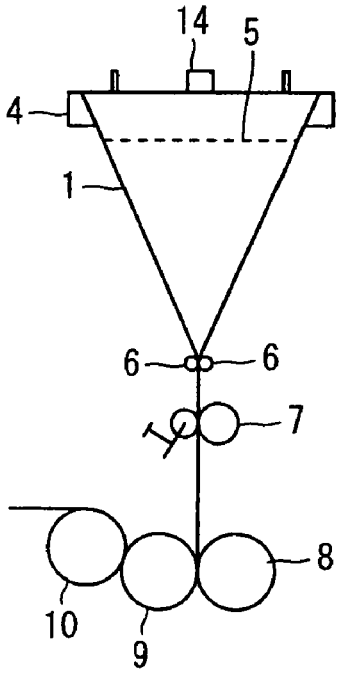
FIG. 8C PRIOR ART
FIG. 8C is a front view of the conventional folding apparatus.

The compensating roller motor 209 is operated so as to change a transport length by forwarding/rewarding the compensating roller 3 as shown in FIG. 8. A varied length is detected by the rotary encoder 211 and counted by the counter 210.

The compensating roller motor 209 is controlled by the CPU 202 in accordance with a position determined by the register mark detector 206 so as to cut a web member correctly.

As a cut-off-control device 200, it may be employed another apparatus for controlling a cutting position of a printed web member in addition to the apparatus as shown in FIG. 1.

FIG. 2 shows an operation flow chart of the control device 100 so as to switch on/off the cut-off-control device 200 by comparing a present revolution number and a memorized revolution number of a printing press.

At first, a start switch is switched on (step S1). In the case where an actual printing signal is switched on in the printing press (step S2), an actual revolution number of the printing press in the actual printing operation is read out (step S3).

The setting revolution number of the printing press in an actual printing operation is previously determined by the device 122 for setting a set revolution number and memorized in the memory 120 for memorizing/outputting a set revolution number.

A revolution number of the printing press in the case of switching on/off the cut-off-control device 200 is computed (step S4).

For example, it is computed a revolution number of the printing press when a tensile force of a web member is stable, that is, 95% of a revolution number of the printing press in the actual printing operation memorized in the memory 120 for memorizing the set revolution number.

The computed revolution number is memorized in the memory means 109.

Successively, the present revolution number of the printing press is read out from the memory 121 for memorizing the present revolution number (step S5) and it is judged whether the present revolution number of the printing press is larger than a revolution number of the printing press in the case where the cut-off-control switch 200 is switched on/off (step S6).

The revolution number of the printing press is detected by the rotary encoder 112 of the printing press driving motor 112 through F/V 111.

If the present revolution number of the printing press is larger the revolution number of the printing press in the case where the cut-off-control device 200 is switched on/off, the cut-off-control device 200 is begun to be controlled (step S7).

The present revolution number of the printing press is read out in the memory 121 for memorizing the present revolution number (step S8) and it is judged whether the present revolution number of the printing press is less than the revolution number of the printing press in the case where the cut-off-control device 200 is switched on/off (step S9).

If the present revolution number of the printing press is less than the revolution number of the printing press in the case where the cut-off-control device 200 is switched on/off, the cut-off-control device 200 is stopped to be controlled (step S10).

The operation is finished by switching off the start switch (step S11).

Figure 3:
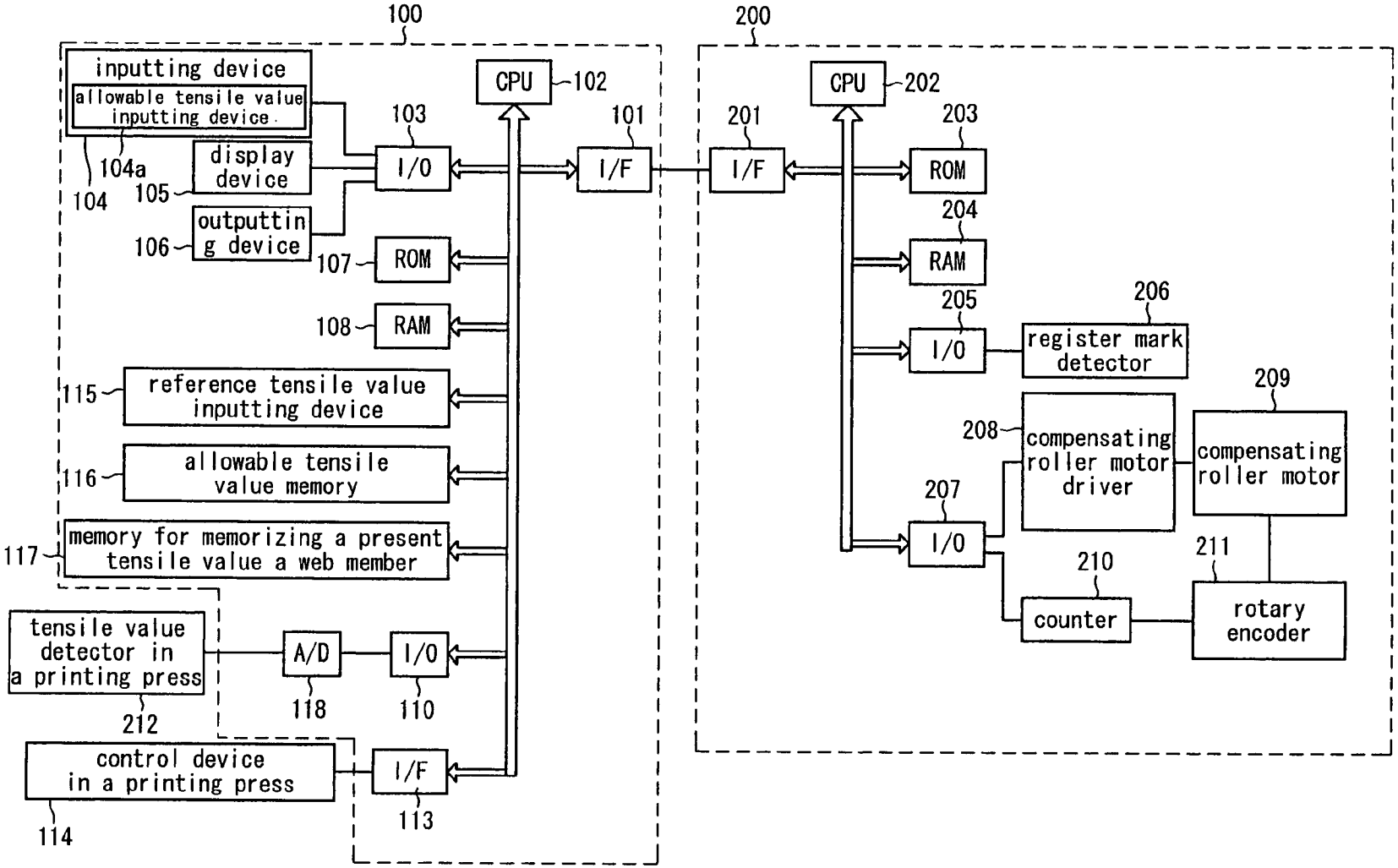
FIG. 3 is a block diagram for showing a second embodiment according to a control device for controlling an apparatus for controlling a cutting position of a web member of a cutting unit in a printing press.

FIG. 3 shows the second embodiment according to the present invention of a control device for controlling an apparatus for controlling a cutting position of a web member.

The embodiment employs an input device including an allowable value inputting device 104*a*, a memory 115 for memorizing/outputting a reference tensile value, a memory 116 for memorizing/outputting an allowable value, and a memory 117 for memorizing a present tensile value of a web instead of the memories 109, 120, and 121 employed in the first embodiment. Further, the second embodiment employs a detector 212 for detecting a tensile force of a web member instead of the rotary encoder 112 of the printing press driving motor.

The memory 115 for memorizing a reference tensile value (reference tensile value memory) and the memory 116 for memorizing an allowable value (allowable value memory) are utilized for memorizing a tensile value of a web member in the case where the cut-off-control device 200 is switched on/off.

Figure 4:
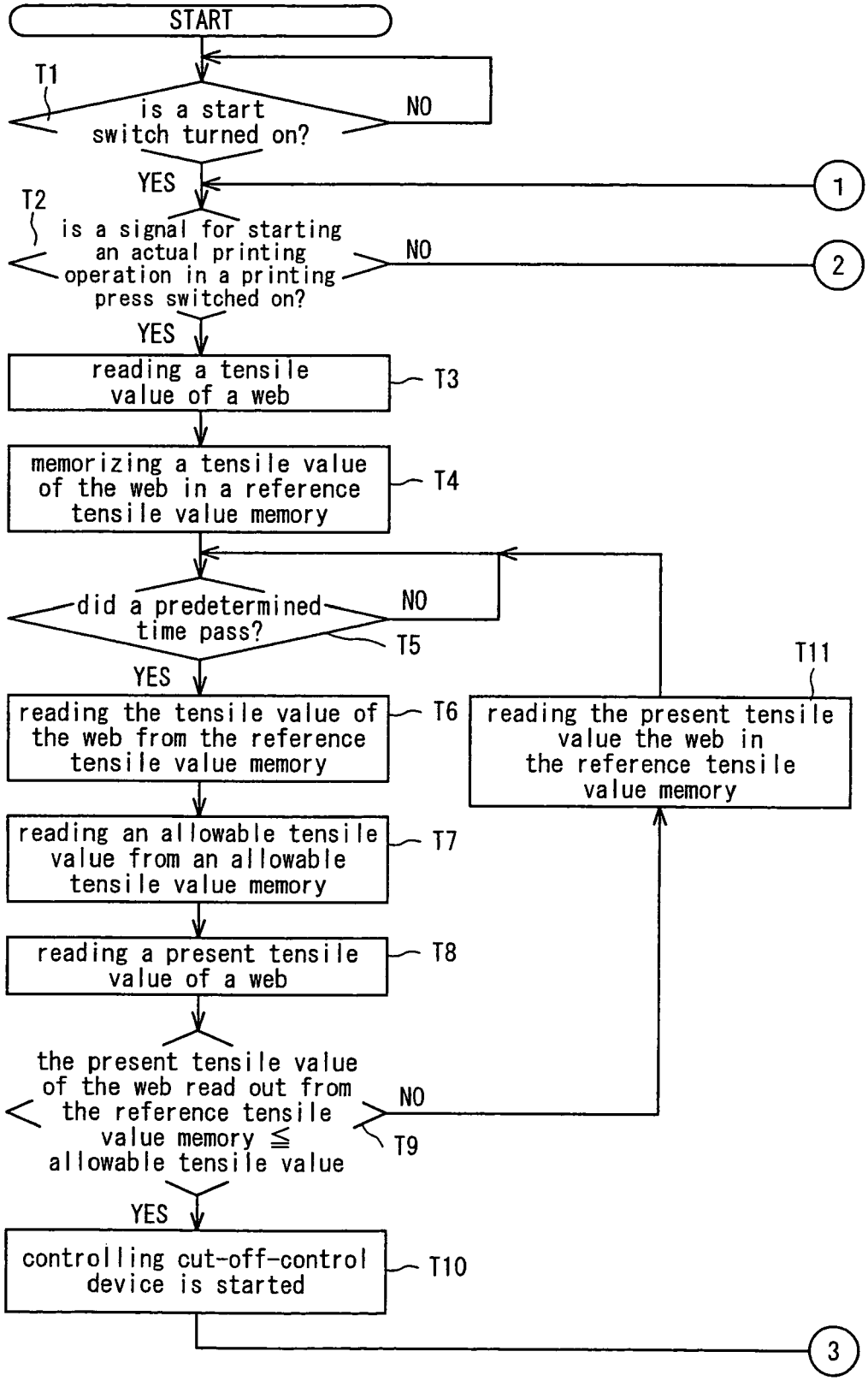
FIG. 4 is a upstream flow chart for showing an operation of a control device for an apparatus for controlling a cutting position of a web member of a cutting unit.
Figure 5:
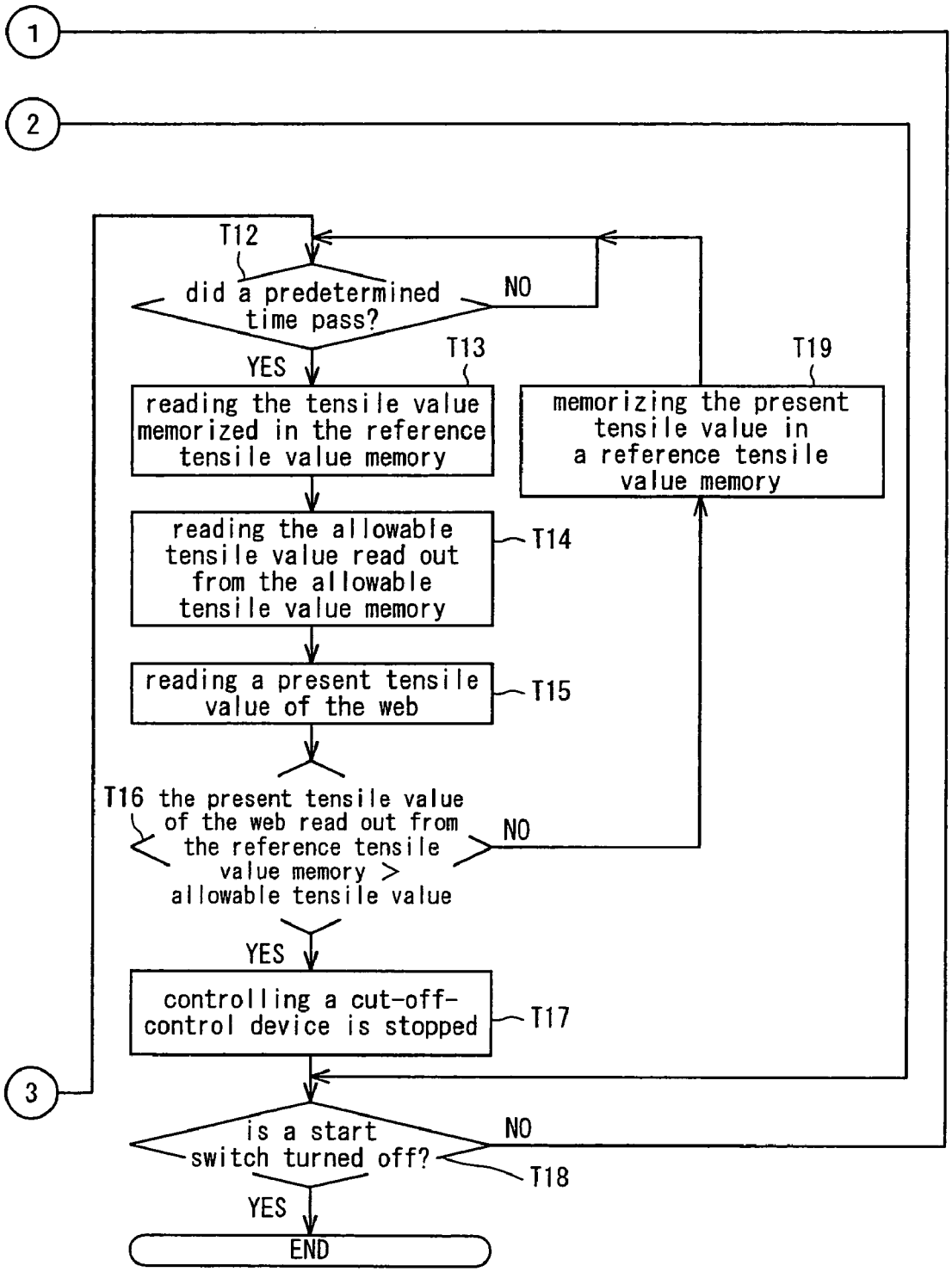
FIG. 5 is a downstream flow chart for showing an operation of a control device for an apparatus for controlling a cutting position of a web member of a cutting unit.

FIG. 4 and FIG. 5 show one example of an operation flow of the above control device 100.

FIGS. 4 and 5 are an operation flowchart so as to switch on/off the cut-off-control device 200 by comparing a tensile force of a web member, that is, a tensile value applied on the web member.

At first, a start switch is switched on (step T1). When a beginning signal for an actual printing operation of the printing press is turned on (step T2), a tensile value of the web member is detected (step T3). The detected tensile value of the web member is memorized in a memory 115 for memorizing a reference tensile value (step T4).

The present tensile value of the web member is detected by a tensile value detector 212 as means for measuring a tensile force of a web member and memorized in the memory 117 for memorizing the present tensile value of a web member 1 through A/D 118 and I/O 110.

After passing a predetermined period (step T5), a tensile value memorized in the reference tensile value memory is read out (step T6), an allowable value is read out from the allowable value memory 116 (step T7), and a present tensile value of a web member is read out (step T8). The allowable value is previously input from the allowable value input device 104*a* in the input device 104 to the memory 116 for memorizing an allowable value.

Successively, it is judged whether a difference between the tensile value read out from the reference tensile value memory 115 and the present tensile value read out from the memory 117 for memorizing a present tensile value is within a range of an allowable value (step T9). If the difference is within the range of the allowable value, the cut-off-control device 20 is started to be controlled.

Unless the difference is within the range of the tensile allowable value, the present tensile value of the web member is input to the reference tensile value memory 115 (step T11). Then, a process from the step T5 to the step T9 is repeated.

After passing the predetermined time (step T12), the tensile value memorized in the reference tensile value memory 115 is read out (step T13), the tensile allowable value is read out from the tensile allowable value memory 116 (step T14), and the present tensile value of a web member is read out from the memory 117 for memorizing a present tensile value (step T15).

It is judged whether a difference between the tensile value read out from the reference tensile value memory 115 and the present tensile value of the web member read out from the memory 117 for memorizing a present tensile value is larger than a tensile allowable value (step T16). If the difference is larger than the tensile allowable value, the cut-off-control device 200 is stopped to be controlled (step 17).

On the other hand, unless the difference is larger than the tensile allowable value, the present tensile value is input to the reference tensile value memory 115 (step T19), a process from step T12 to a step T16 is repeated.

Then, the start switch is turned off (step T18), the control operation is stopped.

Figure 9:
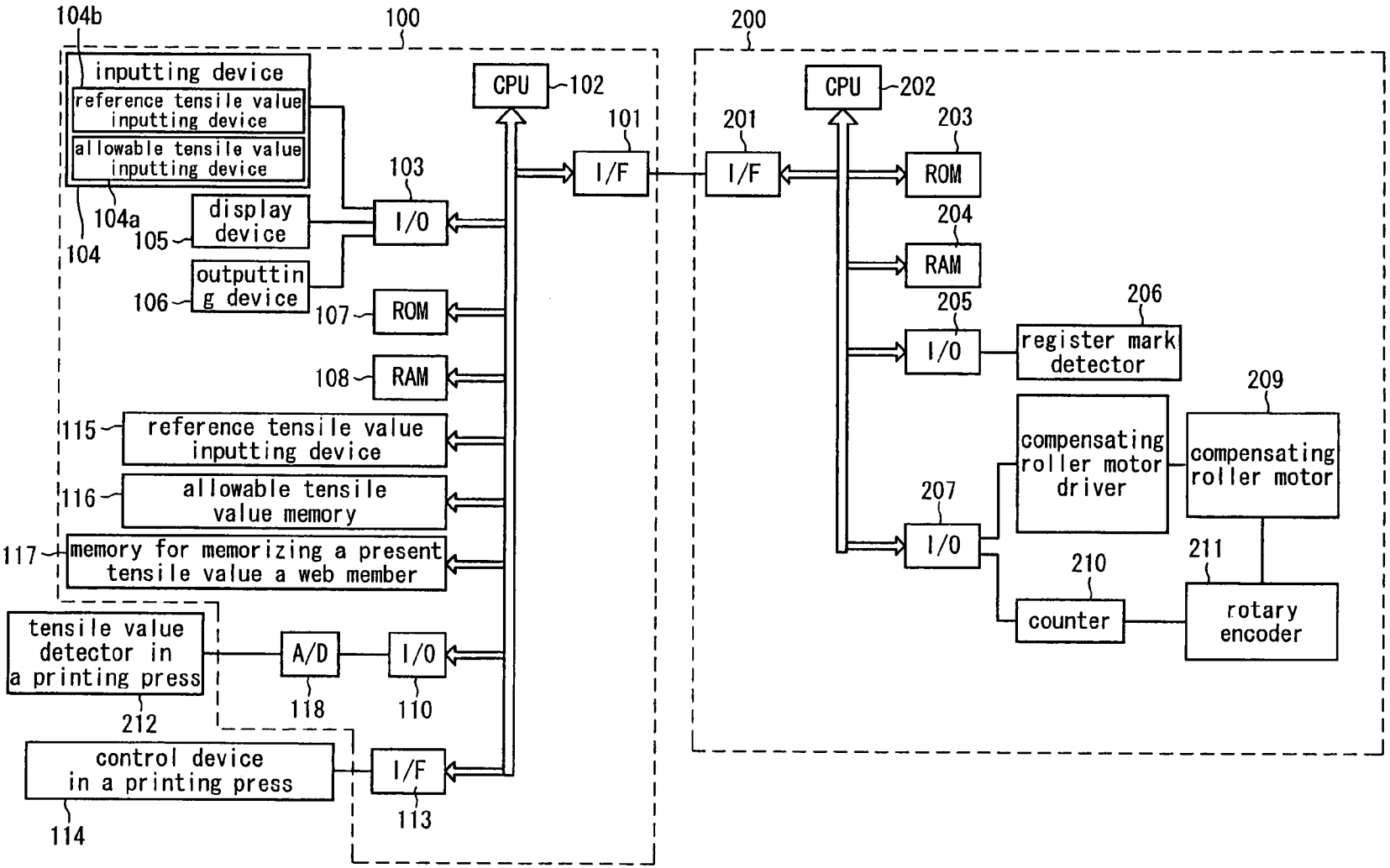
FIG. 9 is a block diagram for showing the third embodiment according to a control device for controlling an apparatus for controlling a cutting position of a web member of a cutting unit in a printing press.

FIG. 9 shows the third embodiment of a control device for controlling an apparatus for controlling a cutting position of a web member according to the present invention.

In the third embodiment, an input device in a control device 100 includes a reference tensile value inputting device 104*b* and an allowable value inputting device 104*a*. A reference tensile value previously memorized from the reference tensile value input device 104*b* in the input device 104 to the reference tensile value memory 115 and an allowable value previously memorized from the allowable value memory input device 104*b* in the input device 104 to the allowable value memory 116 are utilized. The other structure of the third embodiment is as similar as the structure as shown in FIG. 3. Therefore, the other explanation is omitted.

Figure 6:
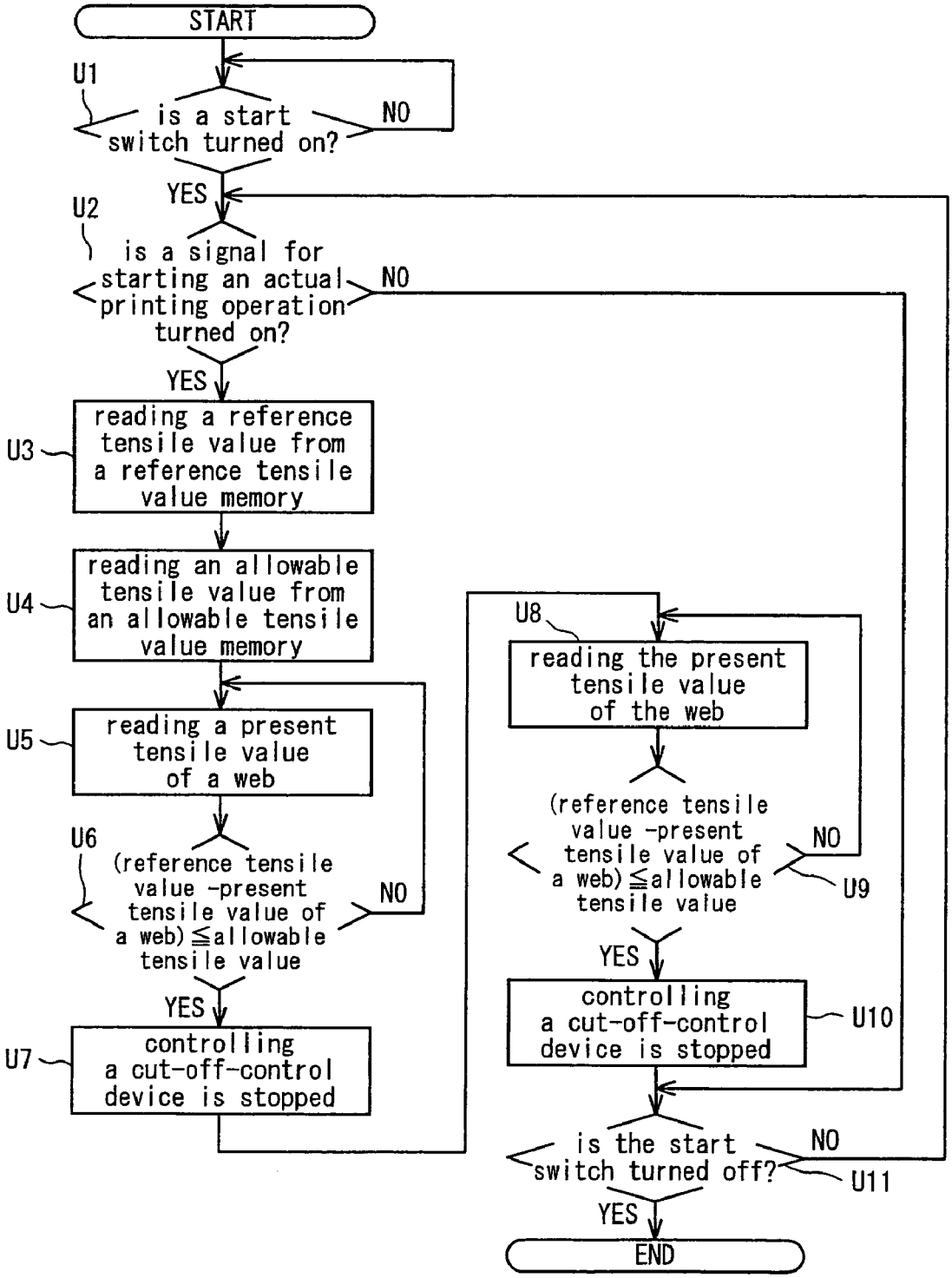
FIG. 6 is a flow chart for showing an operation of a control device for an apparatus for controlling a cutting position of a web member of a cutting unit.
Figures 7A, 7B, 7C:
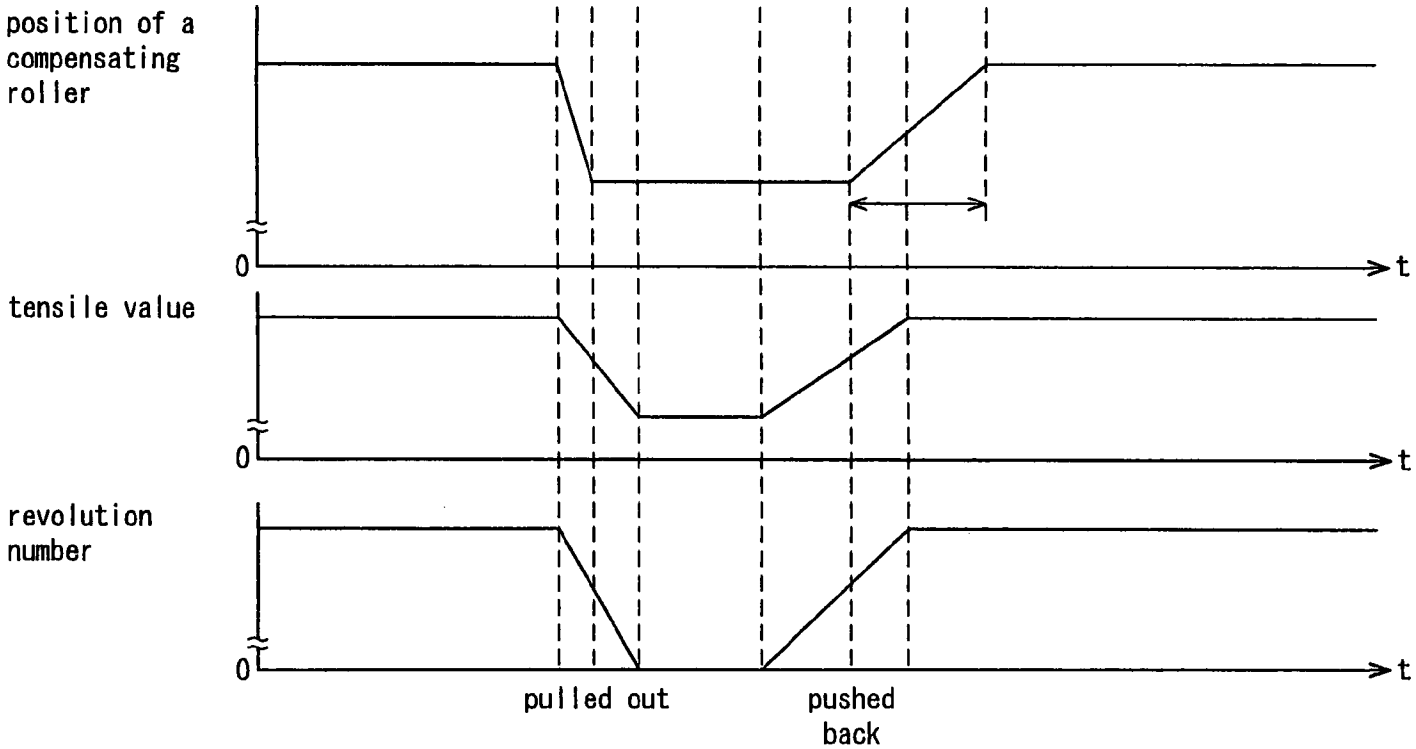
FIG. 7A (Related Art)
FIG. 7B (Related Art)
FIG. 7A is a graph for showing a movement of a conventional compensating roller while a printing cylinder is pulled out and pushed back.
FIG. 7B is a graph for showing a tensile value of a conventional compensating roller while a printing cylinder is pulled out and pushed back.
FIG. 7C is a graph for showing a rotational speed (revolution number) of the printing cylinder in a printing press while a printing cylinder is pulled out and pushed back.

FIG. 6 shows an operation flow of the control device 100 of the third embodiment.

At first, a start switch is turned on (step U1). When a signal for starting an actual printing operation in a printing press is generated (step U2), a reference tensile value is read out from a reference tensile memory 115 (step U3), a tensile allowable value is read out from the tensile allowable memory 116 (step U4), and a present tensile value of a web member is read out from the memory 117 for memorizing a present tensile value (step U5).

It is judged whether a difference between the tensile value read out from the reference tensile value memory 115 and the present tensile value of the web member read out from the memory 117 for memorizing a present tensile value is within a range of the tensile allowable value (step U6). If the difference is within the range of the tensile allowable value, a cut-off-control device 200 is started to be controlled (step U7).

On the other hand, unless the difference is within the range of the tensile allowable value, a process from the step U5 to the step U6 is repeated.

Successively, a present tensile value of the web member is read out from the memory 117 for memorizing the present tensile value (step U8).

Further, it is judged whether a difference between the reference tensile value memory 115 and a present tensile value of the web member read out from the memory 117 for memorizing the present tensile value is greater (step U9). If the difference is larger the tensile allowable value, the cut-off-control device 200 is stopped to be controlled (step U10).

Then, the start switch is turned off (step U11), the control operation is stopped.

As described above with reference to the embodiments, in the present invention, an apparatus for controlling a cutting position of a cutting unit in a printing press is switched on/off in accordance with a present revolution number with respect to a revolution number in an actual printing operation or the stability of a tensile value of a web member. A compensating roller can be returned to a correct position in a short period of time so that cutting can be operated correctly and waste of printing material can be avoided.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A method for controlling an apparatus for controlling a cutting position of a web member of a web cutting unit, comprising:

setting a reference tensile value of said web member in an actual printing operation;

detecting a present tensile value of said web member; and starting said apparatus for controlling a cutting position of said web member when the difference between the detected present tensile value of said web member and said reference tensile value is equal to or less than an allowable tensile value; and stopping said apparatus for controlling the cutting position of said web member when the difference between said detected present tensile value of said web member and said reference tensile value is equal to or greater than an allowable tensile value.

2. Apparatus for controlling a cutting position of a web member of a web cutting unit, comprising:

means for setting a reference tensile value of said web member in an actual printing operation;

means for detecting a present tensile value of said web member; and control means for starting the apparatus for controlling the cutting position of said web member when the difference between the detected present tensile value of said web member and said reference tensile value is equal to or less than an allowable tensile value; and said control means also stopping said apparatus for controlling the cutting position of said web member when the difference between the detected present tensile value of said web member and said reference tensile value is equal to or greater than an allowable tensile value.

3. Apparatus for controlling a cutting position of a web member of a web cutting unit as claimed in claim 2, and further comprising:

a compensating roller movably supported to vaiy a transport length of said web member and adjust a cutting position thereof; and detecting means for detecting a mark printed on the web member, and, wherein said control means moves a position of the compensating roller in accordance with a signal output from said detecting means.

4. A method for controlling an apparatus for controlling a cutting position of a web member of a web cutting unit, comprising the steps of:

setting a stable factor of a printing press by setting a reference tensile value in an actual printing operation;

detecting an unstable factor of the printing press by detecting a present tensile value of said web member; and, starting said apparatus for controlling the cutting position of said web member when the difference between the detected present tensile value of said web member and the reference tensile value is equal to or less than an allowable tensile value; and stopping said apparatus for controlling the cutting position of said web member when the difference between said detected present tensile value of said web member and said reference tensile value is equal to or greater than an allowable tensile value.

5. Apparatus for controlling a cutting position of a web member of a web cutting unit, comprising:

stable factor setting means for setting a stable factor of a printing press by setting a reference tensile value in an actual printing operation;

unstable factor detecting means for detecting an unstable factor of a printing press by detecting a present tensile value of said web member; and, control means for starting said apparatus for controlling the cutting position of said web member when the difference between the detected present tensile value of said web member and the reference tensile value is equal to or less than an allowable tensile value; and said control means also stopping said apparatus for controlling the cutting position of said web member when the difference between said detected present tensile value of said web member and said reference tensile value is equal to or greater than an allowable tensile value.

6. Apparatus for controlling a cutting position of a web member of a web cutting unit as claimed in claim 5, and further comprising:

a compensating roller movably supported to vary a transport length of said web member and adjust a cutting position thereof; and detecting means for detecting a mark printed on the web member, and, wherein said control means moves a position of the compensating roller in accordance with a signal output from said detecting means.

* * * * *